US005094159A

United States Patent [19]

Manschwetus

[11] Patent Number: 5,094,159

[45] Date of Patent: Mar. 10, 1992

[54] SLIDE CRADLE FOR A SCRAP CUTTER

[75] Inventor: Helmut Manschwetus, Fuldabrück, Fed. Rep. of Germany

[73] Assignee: Thyssen Industrie AG, Fed. Rep. of Germany

[21] Appl. No.: 575,296

[22] Filed: Aug. 30, 1990

[30] Foreign Application Priority Data

Aug. 31, 1989 [DE] Fed. Rep. of Germany ..... 3928863

[51] Int. Cl.[5] ..... B30B 15/30; B30B 9/32

[52] U.S. Cl. ..... 100/215; 100/233; 100/253; 100/95; 83/923

[58] Field of Search ..... 100/94, 95, 141, 215, 100/232, 233, 253, 901; 83/923

[56] References Cited

U.S. PATENT DOCUMENTS 3,610,138 10/1971 Galter ..... 100/233
4,086,850 5/1978 Becker et al. ..... 100/901

FOREIGN PATENT DOCUMENTS 2056715 5/1972 Fed. Rep. of Germany .
8717229 10/1987 Fed. Rep. of Germany .
0097800 6/1984 Japan ..... 100/94
0555025 5/1977 U.S.S.R. ..... 100/232
2000070 1/1979 United Kingdom ..... 100/95

*Primary Examiner*—Harvey C. Hornsby
*Assistant Examiner*—Tony G. Soohoo
*Attorney, Agent, or Firm*—Robert W. Becker & Associates

[57] ABSTRACT

A slide cradle is provided that includes a stationary well, a feed slide that is movable along the stationary wall, and a compactor wall this is disposed across from the stationary wall, rests upon a loading and compacting base, and is angularly adjustable about both ends, with this compactor wall being pivotably guided at one of the ends along a stationary side wall about a hinged support. The opposite, convexly curved free end of the compactor wall rests against a concavely curved side of the closure wall, with the convexly curved free end and the concavely curved side of the closure wall having the same center of curvature and being positively interconnected in such as way as to permit the convexly curved free end of the compactor wall to be guided along the concavely curved side of the closure wall.

5 Claims, 13 Drawing Sheets

SLIDE CRADLE FOR A SCRAP CUTTER

BACKGROUND OF THE INVENTION

The present invention relates to a slide cradle for a scrap cutter or a scrap-baling press, and includes a stationary wall, a feed pusher or slide that is movable along the stationary wall, and a compactor wall that is disposed across from the stationary wall, rests upon a loading and compacting base, and, via two hydraulic cylinders that can be actuated independently of one another, is angularly adjustable about both ends. The compactor wall is pivotably guided at one of the ends along a stationary side wall about a hinged support that has a vertical pivot axis. The opposite, free end of the compactor wall rests against a concave side of a closure wall that is movably guided on a base plate of the slide cradle in two degrees of freedom in such a way that not only is the contact between the compactor wall and the closure wall always maintained, but also constant contact is established between a convexly curved end face of the closure wall and a facing planar side surface of the feed slide as long as the feed slide is in a starting position.

With such slide cradles, a movable olosure wall is intended to prevent the material that is to be compacted from leaving the effective arrange of the angularly adjustable compactor wall at the free, unguided end.

It is known with slide cradles for scrap cutters, in the region between the free, unguided end of the compactor wall, which is angularly adjustable about both of its ends, and the feed slide in its starting position, to dispose a closure wall that is movable in two degrees of freedom upon the base plate of the slide cradle (DE-GM 87 17 229). The convex end face of this movable closure wall contacts the side surface of the feed slide and maintains its contact with this feed slide via positive means, suoh as cams and pertaining curved grooves between the closure wall and the base plate of the slide oradle. To close the interior of the slide cradle, the movable closure wall is brought into positive contact with the vertical front edge of the free, unguided end of the angularly adjustable compactor wall via hydraulic cylinders and/or springs.

Also known is a slide cradle for a scrap cutter where the end wall remote from the cutter is provided as the closure wall and is movable upon the base plate of the slide cradle with only one degree of freedom (DE-PS 20 56 715). With this known arrangement, the closure wall, which rests under the effect of a resiliently yielding force against the adjacent ends of the side compactor, is either pivotable about a fixed connection or is displaceable in the manner of a drawer.

Unfortunately, the positive closing of the periphery of the slide cradle does not ensure a disruption-free operation, since the material that is to be compacted can, after overcoming the spring or hydraulic cylinder force, become jammed between the movable closure wall and the angularly adjustable compactor wall.

A further drawback is that the constant positive or frictional connection between the movable closure wall and the angularly adjustable compactor wall caused by the forces of the springs and/or the hydraulic cylinders, leads to increased friction and hence to increased wear as well as to an increased requirement of force for the drive means of the angularly adjustable compactor wall.

It is therefore an object of the present invention to improve a slide cradle of the aforementioned general type in such a way that a jamming of the material that is to be compacted between the movable closure wall and the free end of the angularly adjustable compactor wall is prevented, and that the power required for the drive means of the angularly adjustable compactor wall is reduced.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
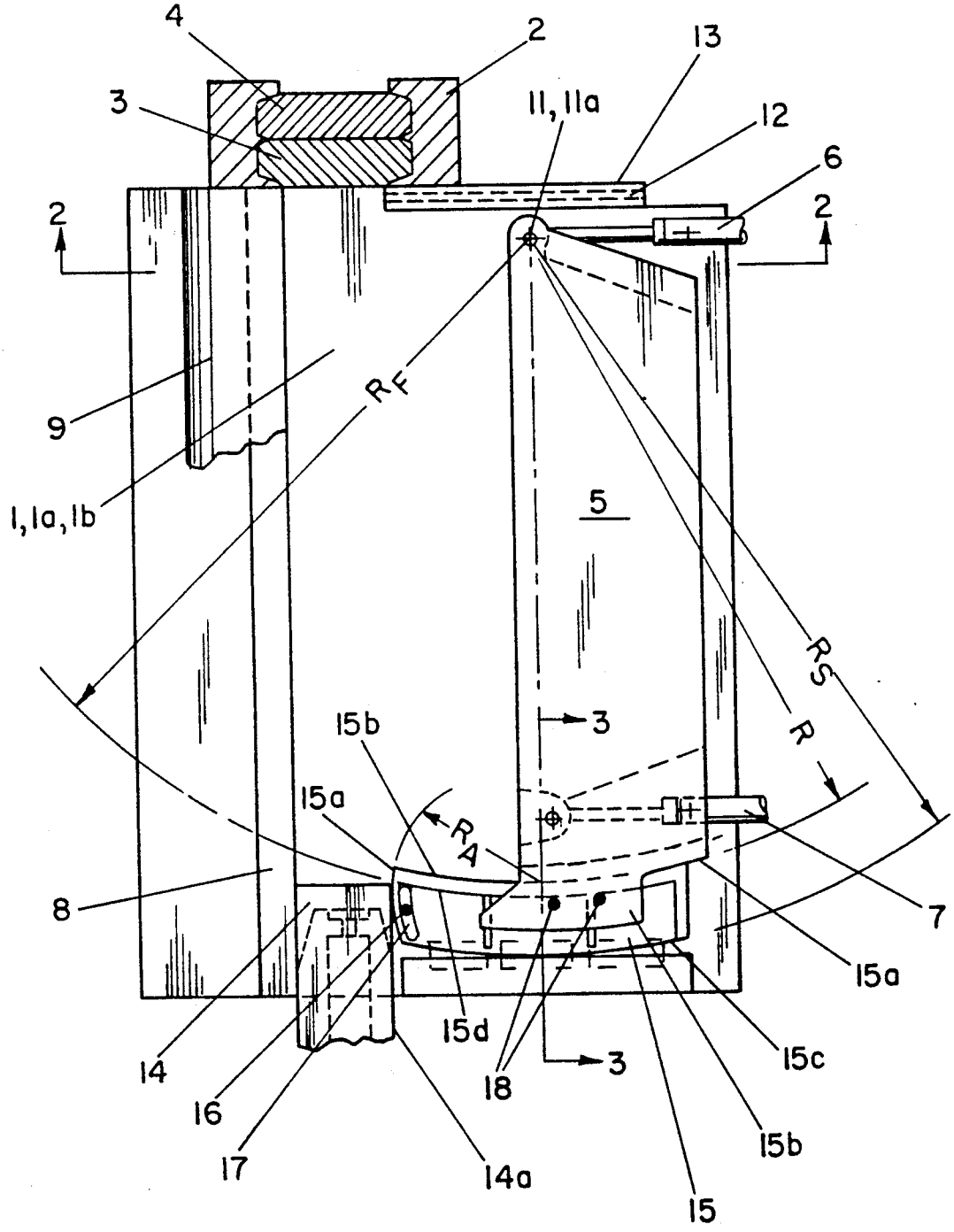
FIG. 1 is a top view of one exemplary embodiment of the inventive slide cradle showing the closure wall in the middle position and also showing roller guide means.

The slide cradle of the present invention is characterized primarily in that the free end of the angularly adjustable compactor wall is convexly curved in the manner of a circular arc and has a radius of curvature, the center of curvature of which is the pivot axis of the hinged support, which is guided on the stationary side wall, with this convexly curved free end of the compactor wall resting on the concave side of the closure wall, with this concave side being concavely curved in the manner of a circular arc, the center of curvature of which is also the pivot axis of the hinged support, with a positive connection being provided between the compactor wall and the closure wall that permits the free end of the compactor wall to be guided along the concave side of the closure wall.

Pursuant to one specific embodiment of the present invention, in order to prevent overloading of the positive connection between the driven angularly adjustable compactor wall and the movable closure wall, it is proposed that that side of the movable closure wall that is remote from the interior of the slide cradle have a convexly shaped surface that is curved in the manner of a circular arc and has a radius, the center of curvature of which is also the pivot axis of the hinged support, with this convexly curved surface riding or rolling on a support wall that is spaced from and parallel to the stationary side wall.

The means for providing a positive connection between the driven angularly adjustable compactor wall and the movable closure wall can be embodied in various ways For example, pursuant to one specific embodiment of the present invention, two spaced-apart rollers having vertical axes of rotation are suspended on the underside of the laterally projecting cover plate of the angularly adjustable compactor wall, with these rollers resting against the rear wall of the movable closure wall, which rear wall has a radius with a center of curvature that is similarly the pivot axis of the hinged support that is guided on the stationary side wall. Pursuant to an alternative embodiment, the movable closure wall has at the top a curved collar-like rim that is directed toward the interior of the cradle, with this collar-like rim positively engaging a curved groove that is disposed on the upper side of the angularly adjustable compactor wall. Pursuant to yet another alternative, the movable closure wall can be extended toward the rear, with this extension being provided with respective upwardly and downwardly projecting guide means that respectively positively engage a downwardly or upwardly projecting rim of the angularly adjustable compactor wall.

The advantages realized with the present invention are that the interior of the slide cradle is positively olosed off in all positions of the angularly adjustable compactor wall, a jamming of material that is to be compacted is prevented, and the power that is required to drive the angularly adjustable compactor wall is reduoed.

Further speoific features of the present invention will be described in detail subsequently.

DESCRIPTION OF PREFERRED EMBODIMENTS

Referring now to the drawings in detail, FIG. 1 is a top view of a slide cradle 1 for a scrap cutter 2 having ram means 3 and a cutter carriage 4. Disposed on the loading and compacting base la is an angularly adjustable compactor wall 5 that can be shifted in the direction toward the stationary wall 8 via the hydraulic cylinders 6, 7, which can be actuated independently of one another. An only partially illustrated cover means 9 is secured on the stationary wall 8 and can close off the press channel from above. At the cutter end of the slide cradle 1, the angularly adjustable compactor wall 5 is provided with a hinged support 11 that has a vertical pivot axis 11*a* and is longitudinally displaceable in a guide groove 12 of the stationary side wall 13. The feed pusher or slide 14, which in FIG. 1 is shown in its retracted starting position, is moved along the stationary wall 8 in the direction toward the scrap cutter 2. On that side opposite the stationary side wall 13, the interior 1*b* of the cradle is closed off by a movable closure wall 15 in every position of the angularly adjustable compactor wall 5. The onvexly curved end face 15*a* of the movable closure wall 15 rests against the facing side surface 14*a* of the feed slide 14 and is positively prevented from lifting off laterally via a fixed guide pin 16 that engages in a curved groove 17 in the base of the movable closure wall 15.

In a direction toward the interior 1*b* of the slide cradle 1, the movable closure wall 15 has a concave side surface 15*b* that is curved in the manner of a circular arc and has a radius of curvature R; in the position illustrated in FIG. 1, the pertaining center of curvature for the radius R is the pivot axis lla of the hinged support 11 of the angularly adjustable compactor wall 5 on the cutter side.

The side surface 5a of the angularly adjustable compactor wall 5 is convexly curved in the manner of a circular arc and rests against the concavely curved side surface 15*b* of the movable closure wall 15. The center of curvature for the pertaining radius of curvature R is the pivot axis 11*a*. As shown in the embodiment of FIG. 1 and the cross-sectional view of FIG. 3, in order to prevent the concavely curved side surface 15*b* from lifting from the abutting convexly curved side surface 5*a*, two adjacent, spaced-apart rollers 18 having vertical axes of rotation are provided. The rollers 18 are mounted on the underside of the overhanging cover plate 5*b* of the angularly adjustable compactor wall 5 and, while featuring the guide radius $R_F$, are supported on the rear wall 15*d* of the movable closure wall 15.

To prevent overload of this positive connection between the movable closure wall 15 and the angularly adjustable compactor wall 5, which connection permits sliding in a peripheral direction, the base of the movable closure wall 15, on that side remote from the interior 1*b* of the slide cradle 1, is provided with a surface 15*c* that is convexly curved in the manner of a circular arc and has a radius of curvature $R_S$, the center of curvature of which in the position illustrated in FIG. 1 is again the pivot axis 11*a*. The convexly curved surface 15*c* rides or rolls on the linear support wall 19, which is spaced from yet extends parallel to the stationary side wall 13.

In the position of the angularly adjustable compactor wall 5 and the movable closure wall 15 illustrated in FIG. 1, the guide pin 16 is disposed approximately in a central position of the curved groove 17 in the base of the movable closure wall 15. In this position, the movable closure wall 15 extends beyond the end face of the feed slide 14 into the interior 1*b* of the slide cradle 1 by an amount equal approximately to $R_F$-R.

Figure 2:
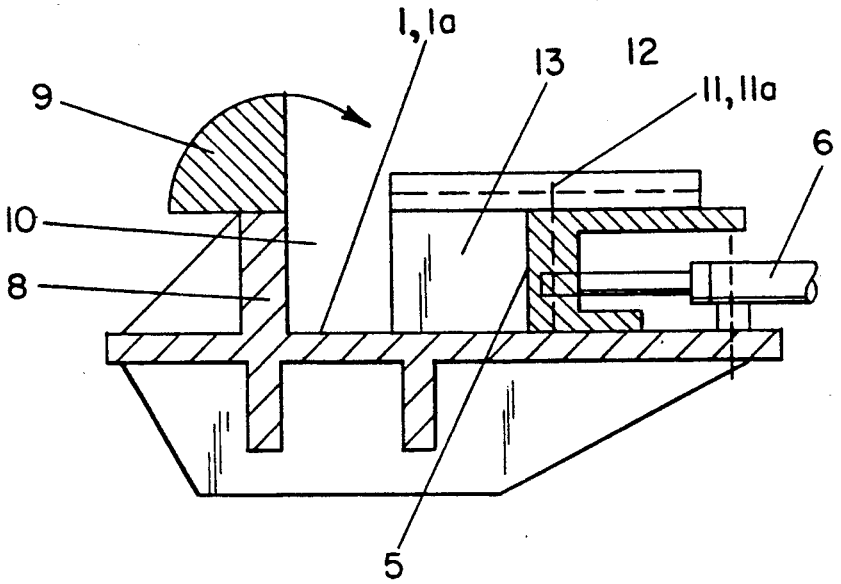
FIG. 2 is a cross-sectional view taken along the line 2—2 in FIG. 1.

As can be seen from FIG. 2, the guide groove 12 for the hinged support 11 is disposed along the upper edge of the fixed side wall 13.

Figure 4:
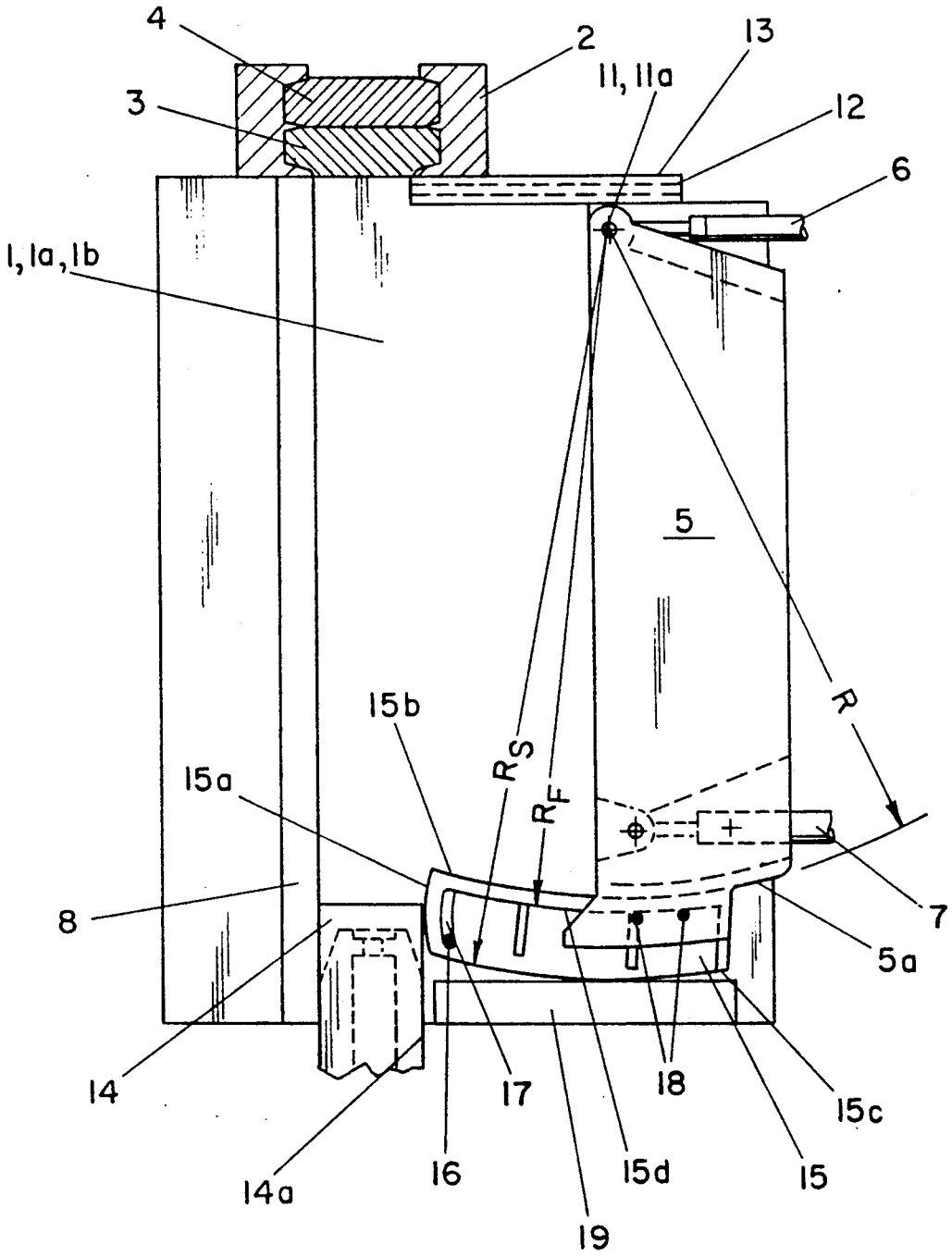
FiG. 4 shows the slide cradle of FIG. 1 in the loading position, with the compactor wall retracted.

In the position illustrated in FIG. 4, the angularly adjustable compactor wall 5 is retracted into its loading position and thu extends at its greatest distance parallel to the stationary wall 8. In this position, the movable closure wall 15 is in its inner end position in which it projects into the interio 1*b* of the cradle.

Figure 5:
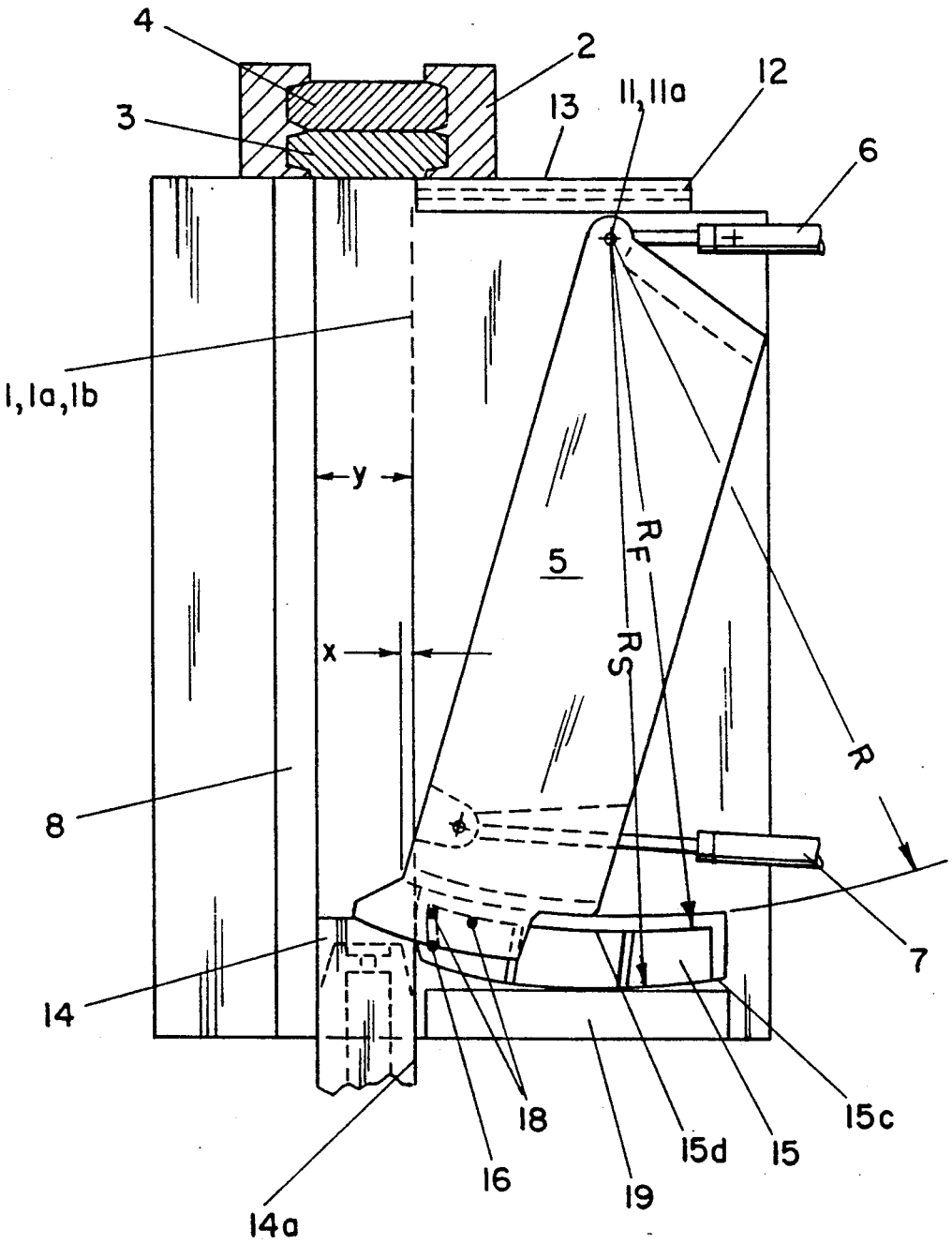
FIG. 5 shows the slide cradle of FIG. 1 in the operating position, with the free end of the compactor wall having been shifted (and including overlap)

In the position illustrated in FIG. 5, the free end of the angularly adjustable compactor wall 5 is shifted via actuation of the hydraulic cylinder 7, whereby the free front end of the compactor wall 5 has overlapped by an amount "x" the width "y" of the loading and compacting base la that is to be covered by the feed slide 14.

Figure 6:
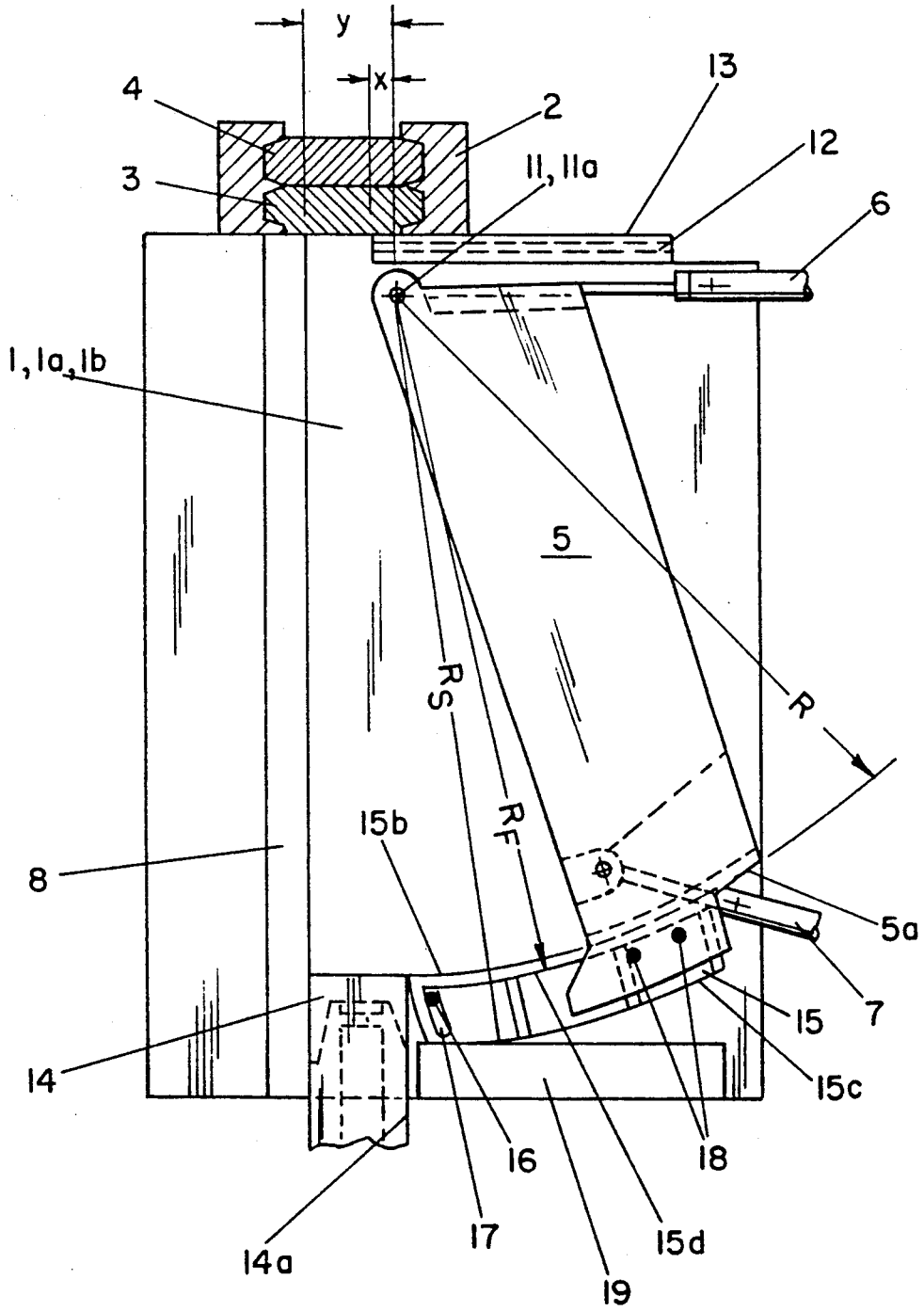
FIG. 6 shows a slide cradle of FIG. 1 in the operating position, with the longitudinally guided end of the compactor wall having been shifted (including overlap)

In the position illustrated in FIG. 6, the longitudinally guided end of the angularly adjustable compactor wall 5 has been shifted by actuation of the hydraulic cylinder 6, whereby again an overlap by the distance "x" takes place. The movable closure wall 15 is in its outer end position, with the end face of the feed slide 14 tangentially adjoining the course of the concavely curved side surface 15*b*.

Figure 7:
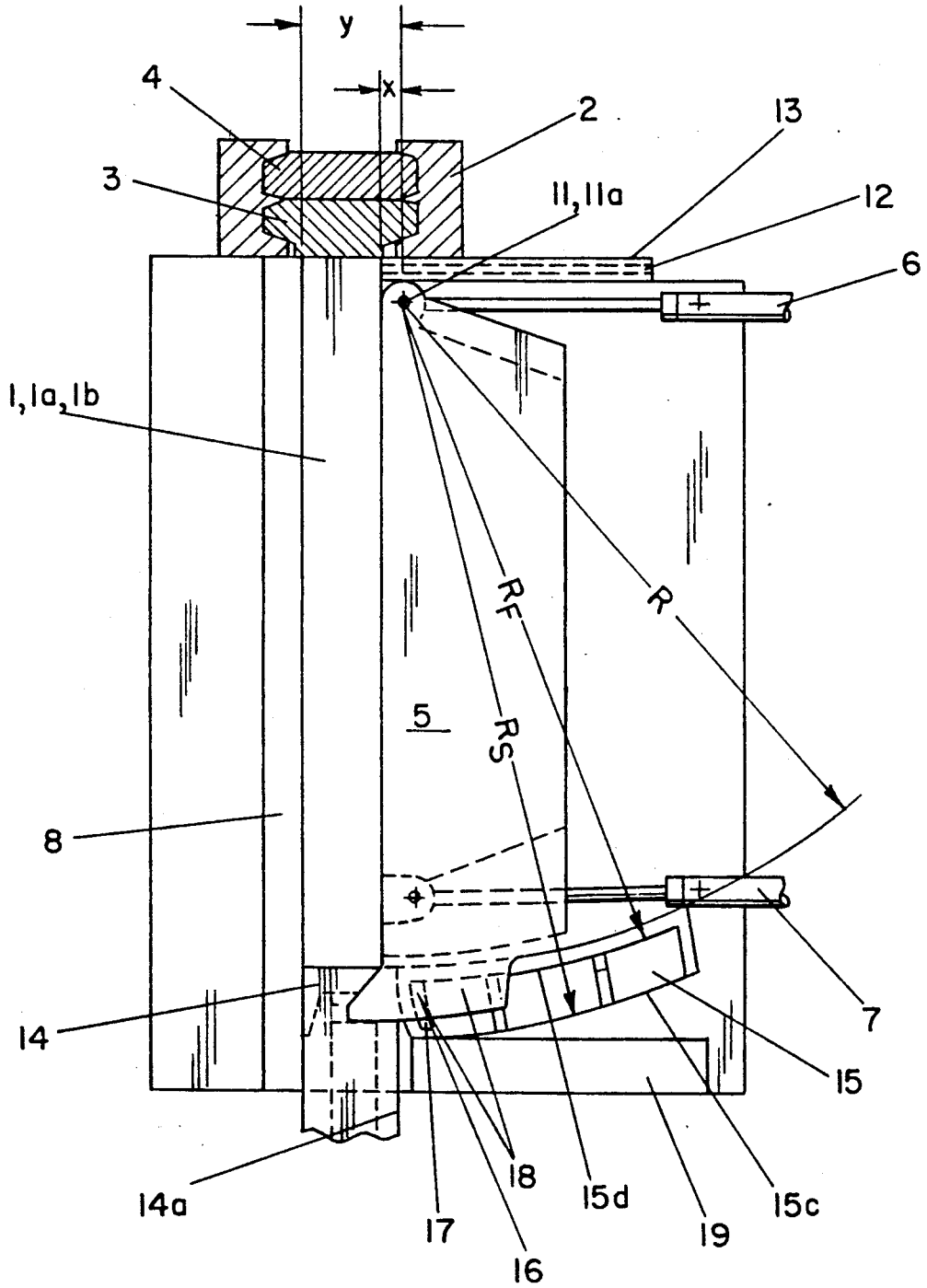
FIG. 7 shows the slide cradle of FIG. 1 in the operating position, with the compactor wall having been shifted parallel to the stationary wall (including overlap)

In the position illustrated in FIG. 7, while maintaining the position of the hydraulic cylinder 6 from FIG. 6 and actuating the hydraulic cylinder 7, the angularly adjustable compactor wall 5 is shifted parallel to the stationary wall 8 into the outermost forward position, whereby the entire length of the front side of the angularly adjustable compactor wall 5 has the overlap "x".

Figure 8:
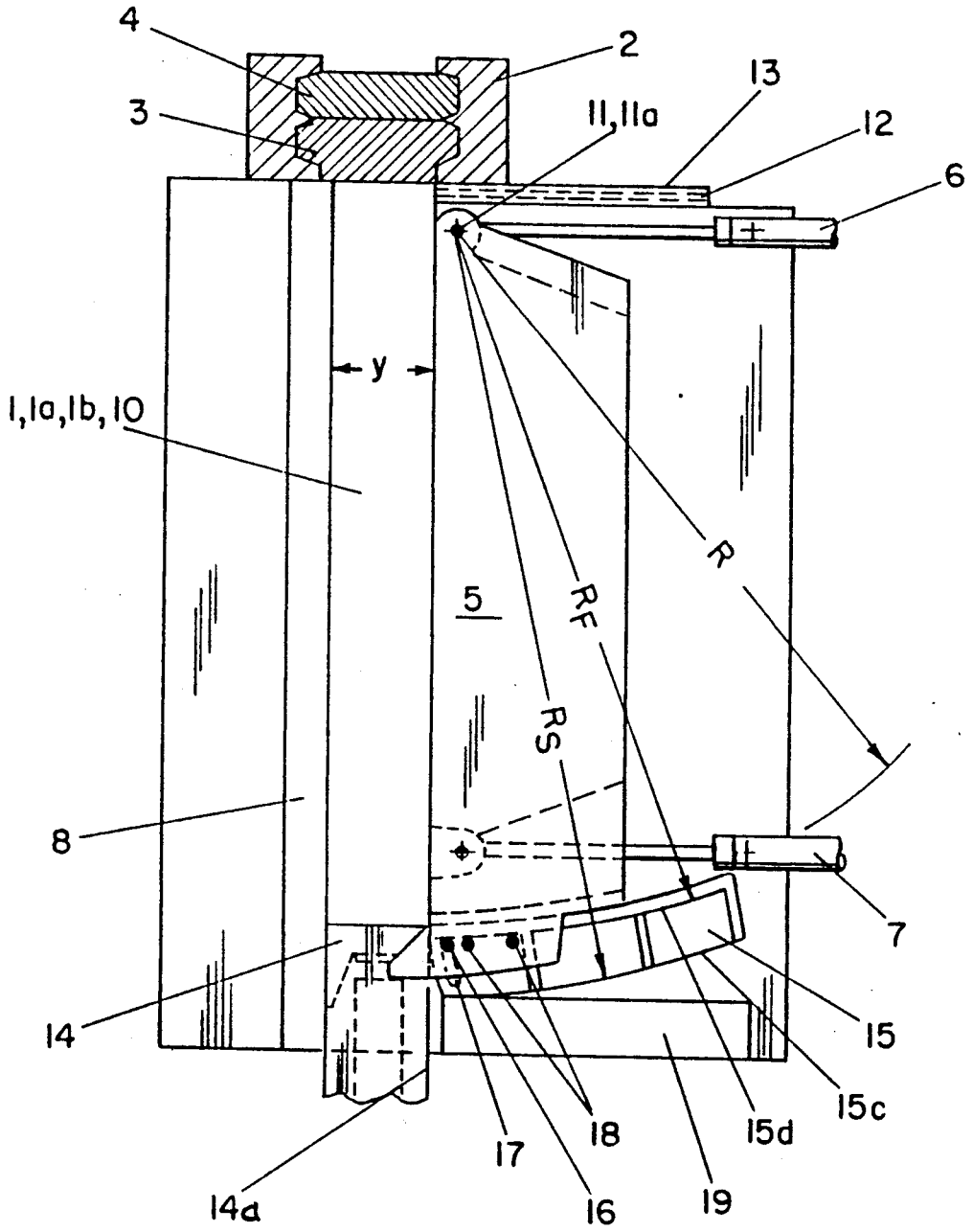
FIG. 8 shows the slide cradle of FIG. 1 in the cutting position.

In the position illustrated in FIG. 8, the angularly adjustable compactor wall 5 is retracted by the amount "x" into the cutting position parallel to the stationary wall 8. The feed slide 14 can now, in stages, push the preliminarily compacted material that is located in the press channel having the width "y" in a direction toward the scrap cutter 2, where the precompacted material is held securely in place by the ram means 3 and is cut by the blades of the cutter carriage 4.

The withdrawal of the angularly adjustable compactor wall 5 out of the position illustrated in FIG. 7 and into the position illustrated in FIG. 8 by the amount "x" (overlap) serves to compensate for the unavoidable springing-back of the compacted material upon conclusion of the pressing movement of the angularly adjustable compactor wall 5, thereby keeping the friction that occurs along the angularly adjustable compactor wall 5 during shifting of the precompacted material ih a direction toward the scrap cutter to a minimum.

Figure 3:
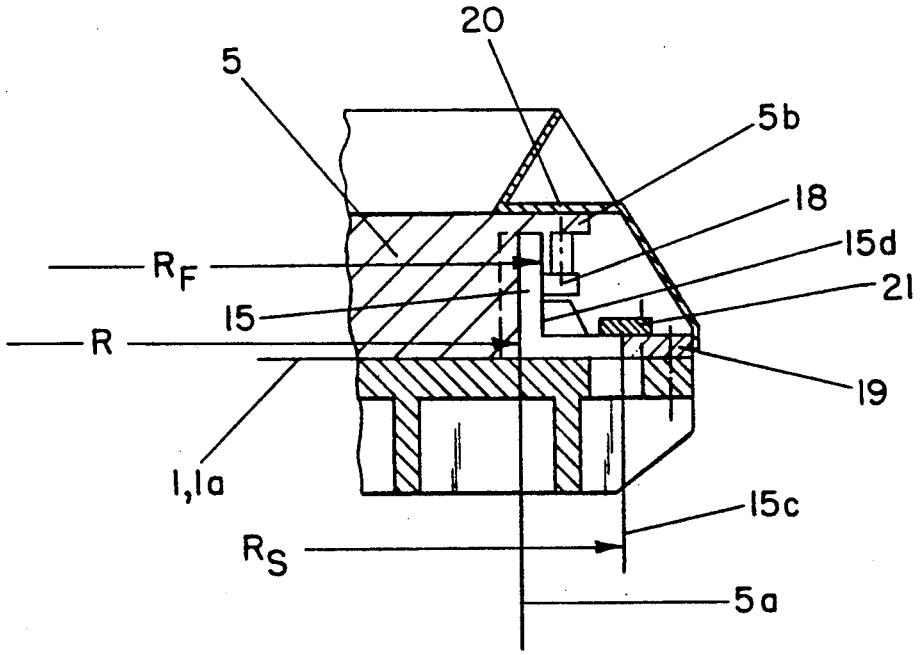
FIG. 3 is a cross-seotional view taken along the line 3—3 in FIG. 1.
Figure 9:
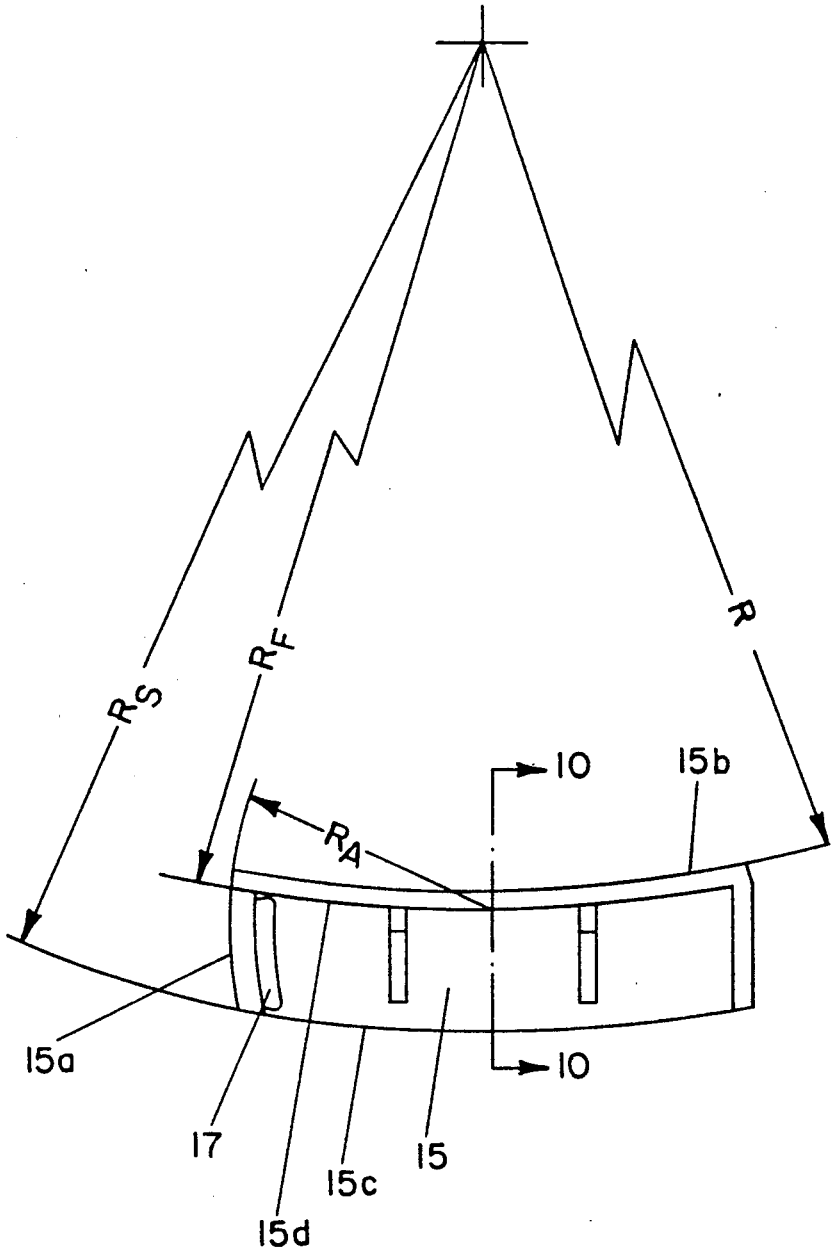
FIG. 9 is a somewhat enlarged view showing the closure wall for roller guidance as in FIGS. 1 and 8.

FIG. 9 is a somewhat enlarged view from above showing the roller guidance of FIGS. 1 and 3 for a movable closure wall 15. The convexly curved end face 15*a* has the radius of curvature $R_A$.

Figure 10:
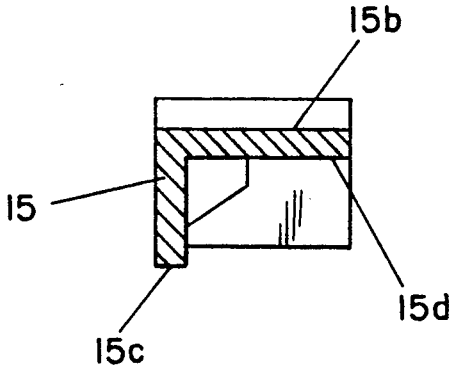
FIG. 10 is a cross-sectional view taken along the line 10—10 in FIG. 9.

FIG. 10 is a cross-sectional view through the closure wall 15 of FIG. 9.

Figure 11:
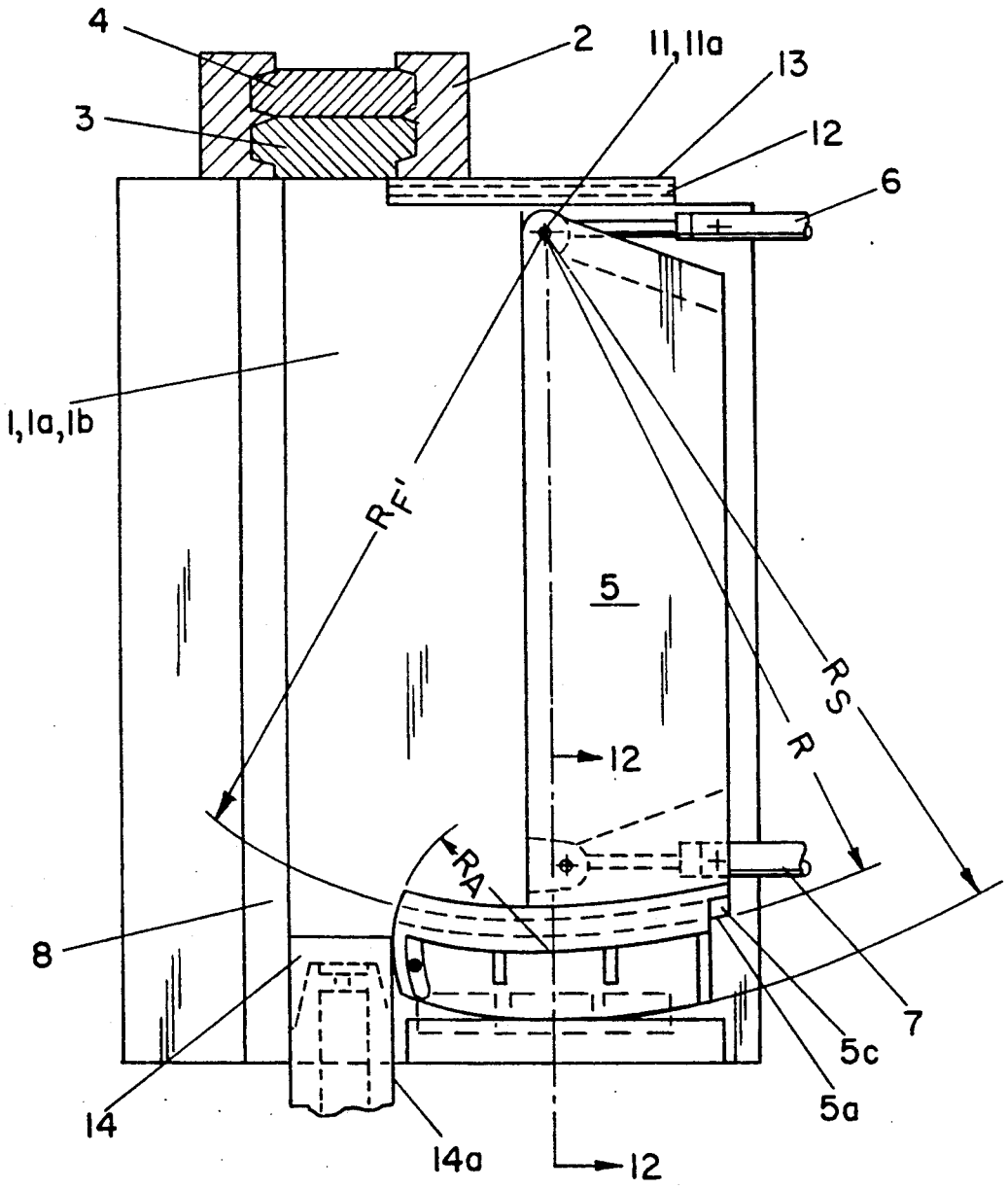
FIG. 11 is a top view of a slide cradle in a position similar to that of FIG. 1, with the closure wall in the middle position but with a grooved guidance on the upper side of the compactor wall.

To illustrate the configuration of the positive connection of the angularly adjustable compactor wall 5 and the movable closure wall 15, which connection can be shifted in a peripheral direction, FIG. 11 shows a view from above onto a slide cradle in a position similar to FIG. 1 with the closure wall 15 in the middle position and a groove guidance at the upper side of the compactor wall 5.

Figure 12:
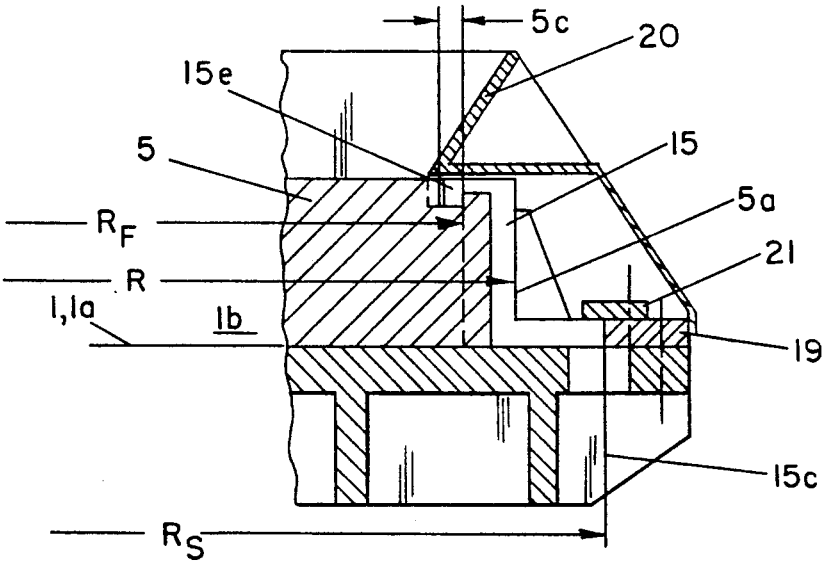
FIG. 12 is a cross-sectional view taken along the line 12—12 in FIG. 11.
Figure 14:
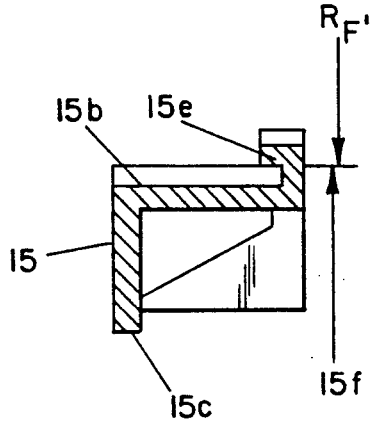
FIG. 14 is a cross-sectional view taken along the line 14—14 in FIG. 13.
Figure 13:
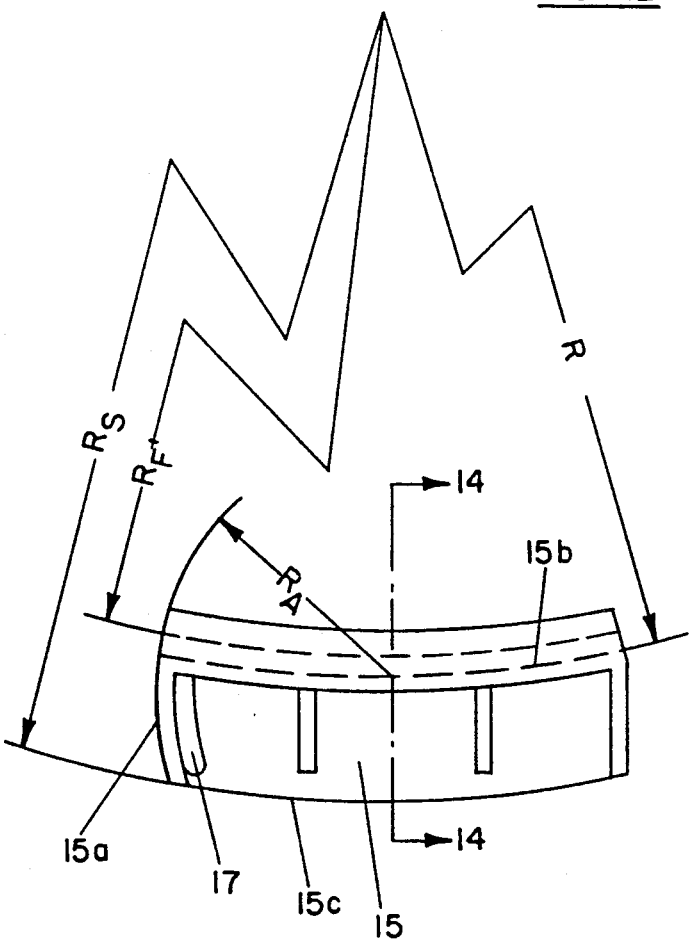
FIG. 13 is a somewhat enlarged view of the closure wall where groove guidance is provided on the upper side of the compactor wall.

As illustrated in the cross-sectional view of FIG. 12, through the slide cradle of FIG. 11, a curved collar-like rim 15*e* that is disposed at the top of the movable closure wall 15 and is directed toward the interior 1*b* of the slide cradle 1 engages from above in a curved groove 5*c* disposed at the top of the angularly adjustable compactor wall 5. The inner vertical surface of the collar-like rim 15*e*, which is effective against lateral lifting, has the radius $R_F$., the center of curvature of which is the vertical pivot axis 11*a*.

Also illustrated in FIG. 12, above the angularly adjustable compactor wall 5, is a funnel-shaped cover means 20 that covers the groove region and prevents material that is to be compacted from falling into this guide means during filling of the slide cradle 1.

In the illustrations of FIGS. 3 and 12, the movable closure walls 15 are positively protected on their back sides from lifting up by overlapping strips 21 that are screwed onto the support walls 19 from above.

Figure 15:
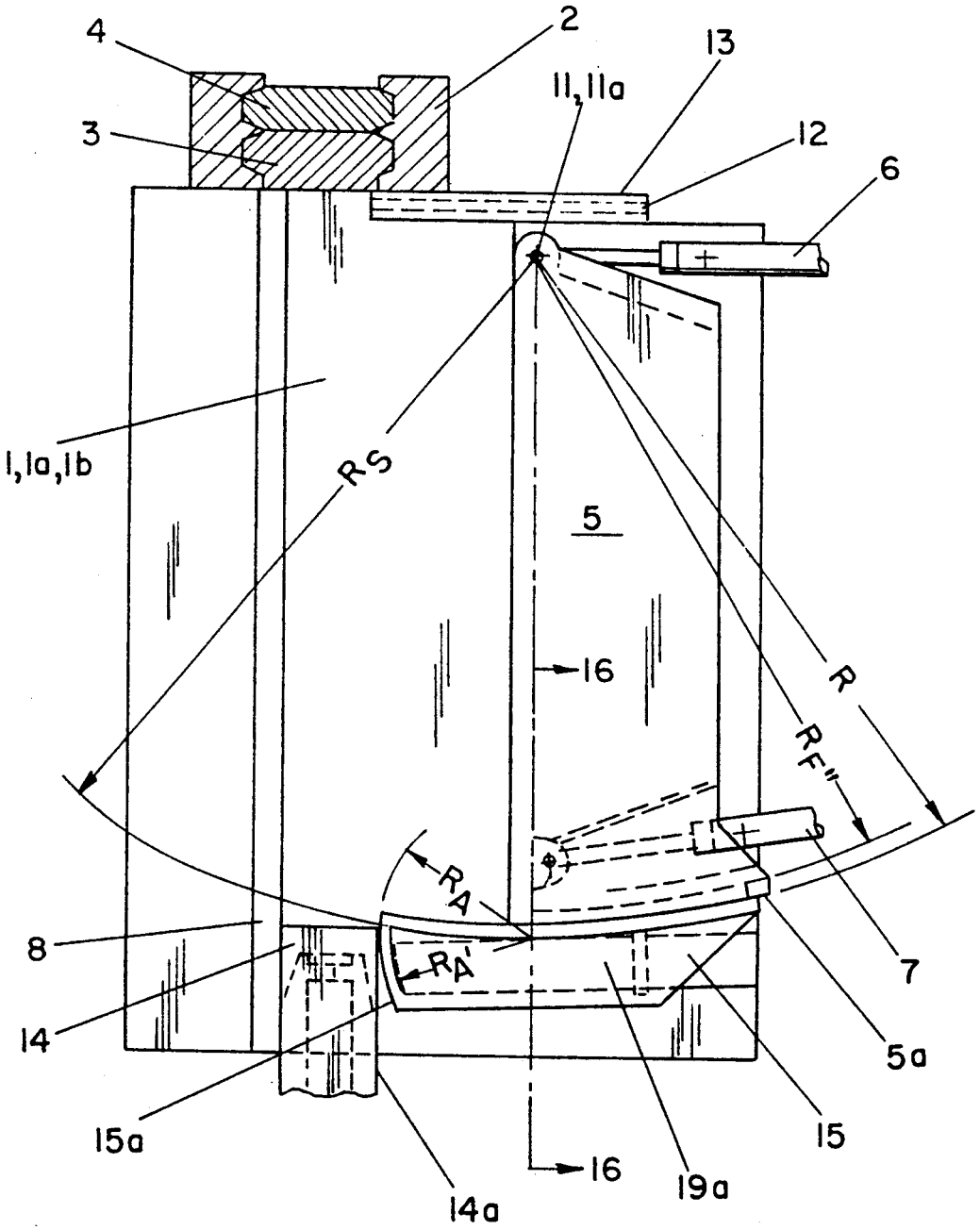
FIG. 15 is a top view of a slide cradle in a position similar to that of FIGS. 1 and 11 and shows a rearwardly extended closure wall in a middle position with a double groove guidance.

Another configuration of the positive connection between the angularly adjustable compactor wall 5 and the movable closure wall 15, which connection can be shifted in a peripheral direction, is shown in the view of FIG. 15 from above onto a slide cradle in a position similar to that of FIGS. 1 and 11, although here with the movable closure wall 15, which is in the middle position, being extended to the rear, and with a double groove guidance being provided on the upper and lower side of the angularly adjustable compactor wall 5.

Figure 16:
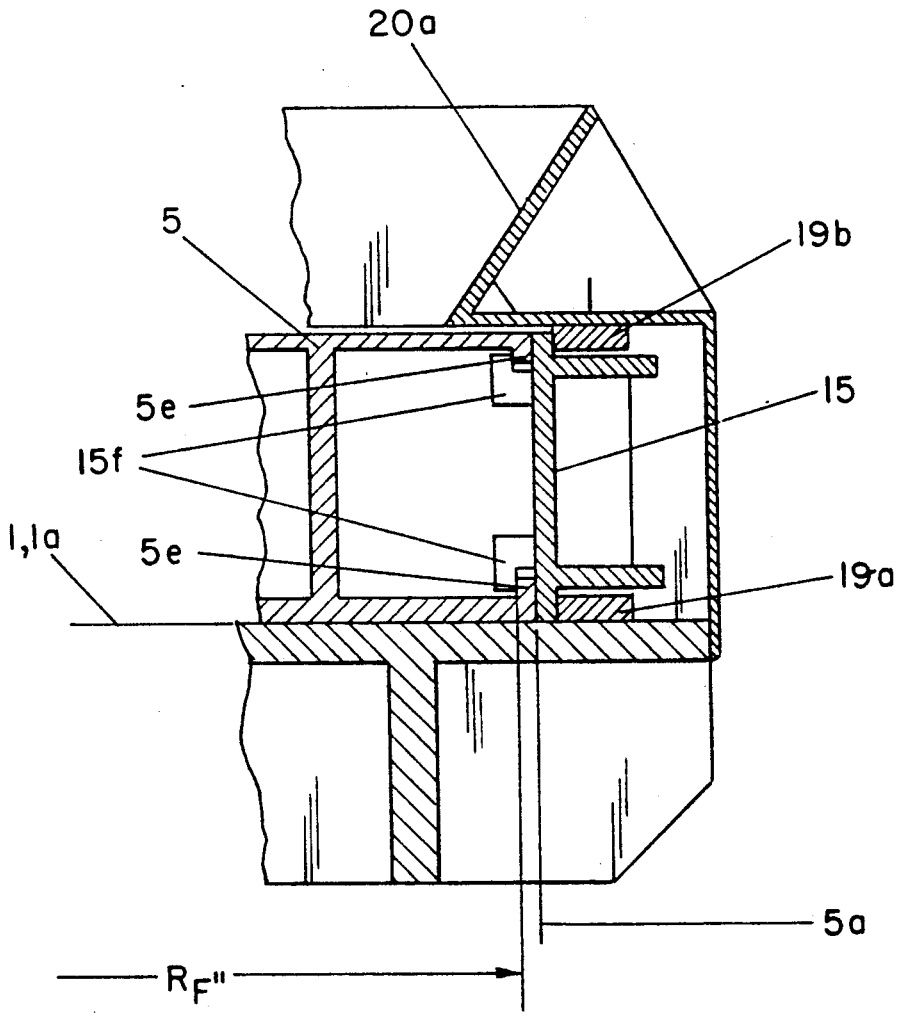
FIG. 16 is a cross-sectional view taken along the lines 16—16 in FIG. 15.
Figure 17:
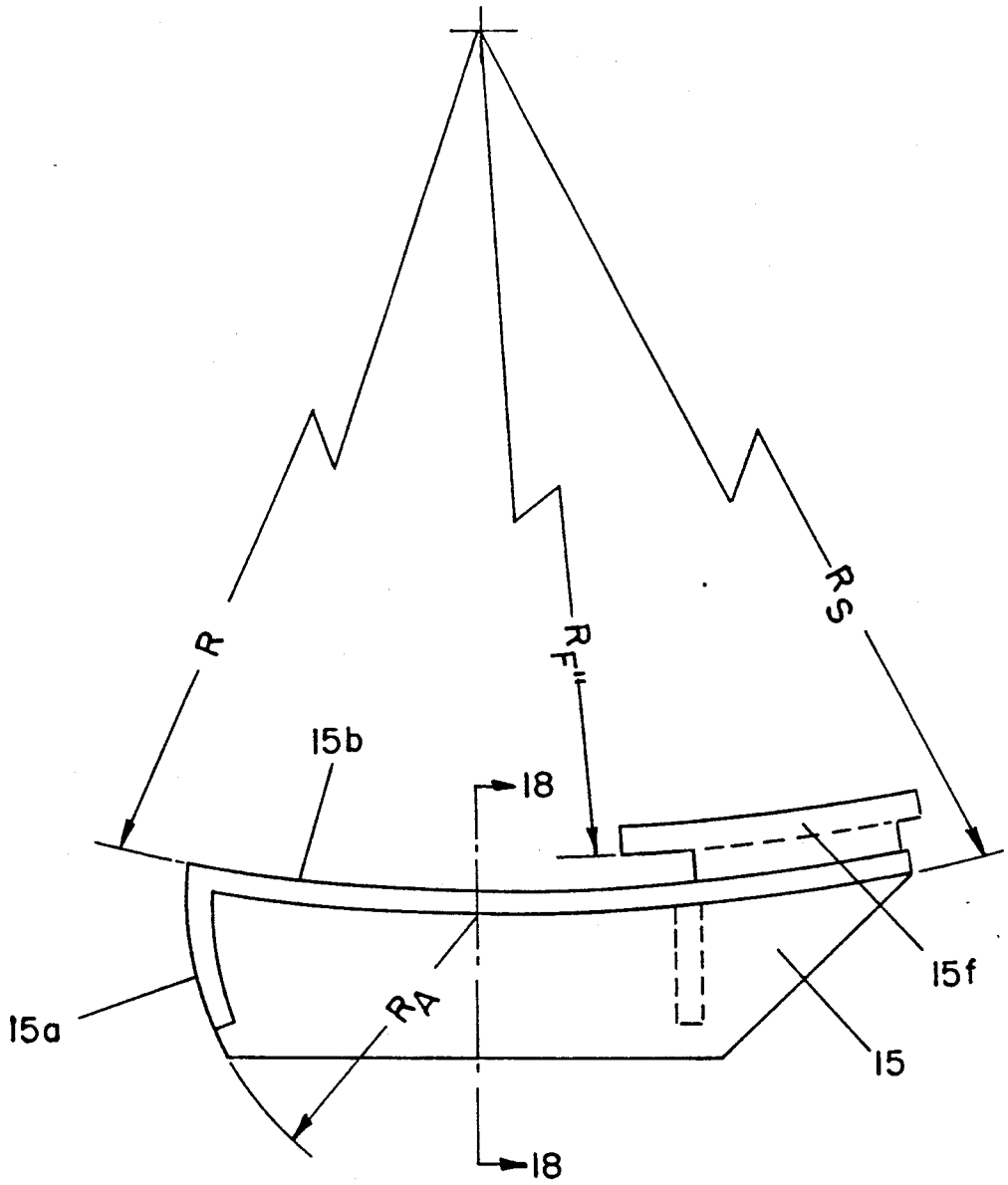
FIG. 17 is a somewhat enlarged view showing an extended closure wall having a double groove guidance.
Figure 18:
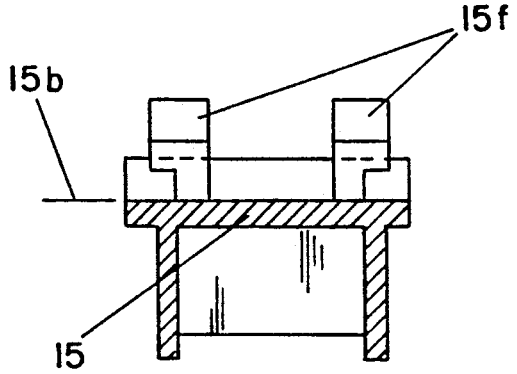
FIG. 18 is a cross-sectional view taken along the line 18—18 in FIG. 17.

As can be seen from FIGS. 16, 17, and 18, that side of the movable closure wall 15 that is remote from the abutment face 15*a*, which is convexly curved in the manner of a circular arc and has the radius $R_A$, is extended and in the region of the extension carries respective upwardly and downwardly projecting curved guide means 15*f* that respectively engage behind a downwardly and an upwardly projecting rim 5*e* of the angularly adjustable compactor wall 5 and in this manner establish the shiftable positive connection that is curved in the manner of a circular arc.

In the embodiment illustrated in FIG. 15, the movable closure wall 15 is not protected against lateral lifting from the side surfaces 14*a* of the feed slide 14 in the same way as with the preceding embodiments, namely via the guide pins 16 and the curved groove 17, but rather via an abutment surface of the support wall 19*a* that is disposed at the base; this abutment surface has an appropriate curvature with the radius $R_{A'}$, and rests against the rear wall of the end face 15*a*, which is convexly curved in the manner of a circular arc and has the radius $R_A$.

The additional support of the movable closure wall 15 of FIG. 15 is effected at the base via the support wall 19*a* and at the top via a similarly shaped support wall 19*b*, which is secured to the underside of the feed hopper 20*a* which is disposed above the angularly adjustable compactor wall 5.

The inner vertical surfaces of the upwardly and downwardly projecting curved guide means 15*f*, which are effective against a lateral lifting, have the radius $R_{F'}$, with the center of curvature being the vertical pivot axis 11*a*.

Also applicable for the embodiments of FIGS. 11 and 15 are the movement sequences for the embodiment of FIG. 1 illustrated in FIGS. 48 for the angularly movable compactor wall 5 and the movable closure wall 15 that is positively secured thereon and can be shifted in a peripheral direction.

With all of the embodiments (see in particular FIGS. 3, 12, and 16), provided above the angularly movable compactor wall 5 and the movable closure wall 15 is a feed hopper 20 or 20*a* that at the same time serves a covering function in order to prevent material that is to be compacted from falling into the guide means.

The present invention is, of course, in no way restricted to the specific disclosure of the specification and drawings, but also encompasses any modifications within the scope of the appended claims.

What I claim is:

1. In a slide cradle for a scrap cutter or a scrap-baling press, and inoluding a first stationary wall, a feed slide that is movable along said first stationary wall and a compactor wall that is disposed across from said first stationary wall, rests upon a loading and compacting base, and, via two hydraulic cylinders that can be actuated independently of one another, is angularly adjustable about two ends, with said compactor wall being pivotably guided at one of said ends along a second stationary side wall about a hinged support that has a vertical pivot axis, and with the opposite, free end of said compactor wall resting against a concave side of a closure wall that is movably guided on a base plate of said slide cradle in two degrees of freedom in such a way that not only is said contact between said compactor wall and said closure wall always maintained, but also constant contact is established between a convexly curved end face of said closure wall and a facing planar side surface of said feed slide as long as said feed slide is in a starting position, the improvement wherein:

said free end of said compactor wall is convexly curved in the manner of a circular arc and has a radius of curvature, the center of curvature of which is said pivot axis of said hinged support, which is guided .on said stationary side wall, with said convexly curved free end of said compactor wall resting on said concave side of said closure wall, with said concave side being concavely curved in the manner of a circular a.rc, the center of curvature of which is also said pivot axis of said hinged support; and connecting means provided between said compactor wall and said closure wall to provide positive connection therebetween and service to guide said convexly curved free end of said compactor wall along said concavely curved side of said closure wall.

2. A slide cradle according to claim 1. in which a side of said movable closure wall remote from an interior of said slide cradle has a surface that is convexly curved in the manner of a circular arc and has a radius of curvature, the center of curvature of which is also said pivot axis of said hinged support, with said last-mentioned convexly curved surface riding on a support wall that is spaced from and parallel to said stationary side wall.

3. A slide cradle according to claim 2, in which said compactor wall has a laterally projecting cover plate; and in whioh said means to provide a positive connection includes two spaced-apart rollers that have vertical axes of rotation and are suspended on an underside of said cover plate, with said rollers resting on a curved rear wall of said closure wall, with said rear wall having a radius of curvature, the centor of curvature of which is also said pivot axis of said hinged support.

4. A slide cradle according to claim 2, in which said means to provide a positive connection includes a curved collar-like rim that is provided at the top of said closure wall and is directed into said interior of said slide cradle, with said collar-like rim positively engaging from above into a curved groove disposed on an upper side of said connector wall.

5. A slide cradle according to claim 2, in which said closure wall has an extension that is directed away from said first stationary wall and is provided with respective upwardly and downwardly projecting guide means that respecively positively engage behind downwardly and upwardly projecting rim means of said compactor wall.

* * * * *